US006619258B2

(12) United States Patent
McKay et al.

(10) Patent No.: US 6,619,258 B2
(45) Date of Patent: Sep. 16, 2003

(54) SYSTEM FOR CONTROLLABLY DISABLING CYLINDERS IN AN INTERNAL COMBUSTION ENGINE

(75) Inventors: Daniel Lee McKay, Brighton, MI (US); Gary Arthur Nichols, Farmington Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/046,932

(22) Filed: Jan. 15, 2002

(65) Prior Publication Data

US 2003/0131820 A1 Jul. 17, 2003

(51) Int. Cl.[7] ..... F02D 17/02
(52) U.S. Cl. ..... 123/350; 123/198 F
(58) Field of Search ..... 123/198 F, 198 D, 123/198 DB, 198 DC, 350, 481

(56) References Cited

U.S. PATENT DOCUMENTS 5,758,616 A * 6/1998 Motose ..... 123/198 F
5,884,603 A * 3/1999 Matsuki ..... 123/198 F
5,970,943 A * 10/1999 Robichaux et al. ..... 123/198 F
5,975,052 A * 11/1999 Moyer ..... 123/198 F
5,979,394 A * 11/1999 Schmidt ..... 123/198 F
6,138,636 A * 10/2000 Kohno et al. ..... 123/198 F
6,158,218 A * 12/2000 Herold et al. ..... 123/198 F
6,260,525 B1 * 7/2001 Moyer ..... 123/198 F
6,360,724 B1 * 3/2002 Suhre et al. ..... 123/198 F
6,363,907 B1 * 4/2002 Arai et al. ..... 123/198 F
6,408,618 B2 * 6/2002 Ide ..... 123/198 F

* cited by examiner

*Primary Examiner*—Henry C. Yuen
*Assistant Examiner*—Jason Benton
(74) *Attorney, Agent, or Firm*—Vincent A. Cichosz

(57) ABSTRACT

A system (10) for controllably disabling cylinders in an internal combustion engine (12) includes a throttle (18) controlling air flow to an intake manifold (14), a number of cylinder deactivation devices ($100_1$–$100_K$) and an engine controller (28) controlling fueling (90), ignition timing (94) and throttle position (86). The controller (28) is operable to activate only the minimum number of cylinders required to achieve a desired engine/vehicle operating parameter value, open the throttle (18) to a computed throttle position, control ignition timing sufficiently to drive the current value of the engine/vehicle operating parameter to the desired engine/vehicle operating parameter value, and to then control the flow area of the throttle (18) while also controlling ignition timing to maintain the current value of the engine/vehicle operating parameter near the desired engine/vehicle operating parameter value. The engine/vehicle operating parameter may be engine output torque, engine speed or vehicle speed.

16 Claims, 7 Drawing Sheets

SYSTEM FOR CONTROLLABLY DISABLING CYLINDERS IN AN INTERNAL COMBUSTION ENGINE

FIELD OF THE INVENTION

The present invention relates generally to systems for controllably disabling cylinders in an internal combustion engine, and more specifically to such systems operable to do so by controlling air intake, fueling and spark timing.

BACKGROUND OF THE INVENTION

Systems for disabling one or more cylinders in an internal combustion engine are known. Such systems are typically operable to disable one or more cylinders in an effort to improve fuel economy under certain engine operating conditions; e.g., steady state and engine idling conditions. However, such known cylinder disabling systems have a number of drawbacks associated therewith.

For example, in engines having mechanically or electronically controlled intake air throttles, engine operation under partial throttle, cruise control and idle control are typically over-throttled, thereby resulting in unnecessary fuel loss. While disabling cylinders; i.e., by selectively disabling operation of one or more cylinders via corresponding cylinder valve deactivation devices or by disabling fueling to one or more cylinders, is known to reduce such throttle losses, the resulting accelerator pedal position required to maintain a engine output torque at a given engine rotational speed becomes "deeper" with each cylinder that is disabled. As a specific example, if cruising at 35 mph requires 25% accelerator pedal deflection with all cylinders enabled, 75% accelerator pedal deflection may be required if some of the cylinders are disabled. Moreover, cylinder disabling under engine idle conditions using known techniques tends to result in undesirable engine/vehicle vibration.

As another example, it is widely recognized that modulating engine output power around "deceleration fuel cut off" (DFCO), or zero indicated engine output torque, is difficult to accomplish. This is largely due to a non-linear relationship that exists between engine output torque increase/decrease and cylinder enabling/disabling. While known DFCO control strategies provide for some improvement, they are generally understood to be inaccurate due to such non-linearities. Additionally, known DFCO control strategies generate high vacuum conditions in the intake manifold, and the fuel consequently does not completely burn in the combustion chambers due to a lack of oxygen. This incomplete combustion generates undesirable increases in hydrocarbon (HC) carbon dioxide (CO) emissions produced by the engine.

What is therefore needed is an improved system for controllably disabling cylinders in an internal combustion engine that does not suffer from the drawbacks of known cylinder disabling strategies.

SUMMARY OF THE INVENTION

The foregoing shortcomings of the prior art are addressed by the present invention. In accordance with one aspect of the present invention, a method is provided comprising the steps of computing a minimum number of a total number of cylinders required to achieve a desired engine/vehicle operating parameter value, computing a maximum throttle position of a throttle controlling air flow into an intake manifold of the engine, enabling operation of the minimum number of cylinders while disabling operation of remaining ones of the total number of cylinders, opening the air intake throttle to the maximum throttle position, determining a current value of the engine/vehicle operating parameter, and controlling ignition timing sufficiently to drive the current value of the engine/vehicle operating parameter to the desired engine/vehicle operating parameter value.

In accordance with another aspect of the present invention, a method is provided comprising the steps of determining air pressure within an intake manifold of the engine, determining rotational speed of the engine, determining road speed of a vehicle carrying the engine, and disabling operation of a number of cylinders of the engine while maintaining an engine/vehicle operating parameter near a desired value of the engine/vehicle operating parameter if the air pressure is below a pressure threshold, the rotational speed of the engine is greater than an engine speed threshold and the road speed of the vehicle is greater than a vehicle speed threshold.

In accordance with a further aspect of the present invention, a method is provided comprising the steps of determining air pressure within an intake manifold of the engine and disabling operation of a number of cylinders of the engine while maintaining a current value of an engine/vehicle operating parameter near a desired value of the engine/vehicle operating parameter if the air pressure is below a first pressure threshold and one of the desired value of the engine/vehicle operating parameter is below an operating parameter threshold and the air pressure is below a second pressure threshold.

The present invention provides a system for controllably disabling cylinders in an internal combustion engine via control of engine fueling or a number of cylinder valve disabling devices, intake manifold throttle position and ignition timing.

The present invention provides such a system for disabling one or more cylinders to improve fuel economy while maintaining an engine/vehicle operating parameter near a desired engine/vehicle operating parameter value.

These and other objects of the present invention will become more apparent from the following description of the preferred embodiment.

DESCRIPTION OF THE PREFERRED EMBODIMENTS

Figure 1:
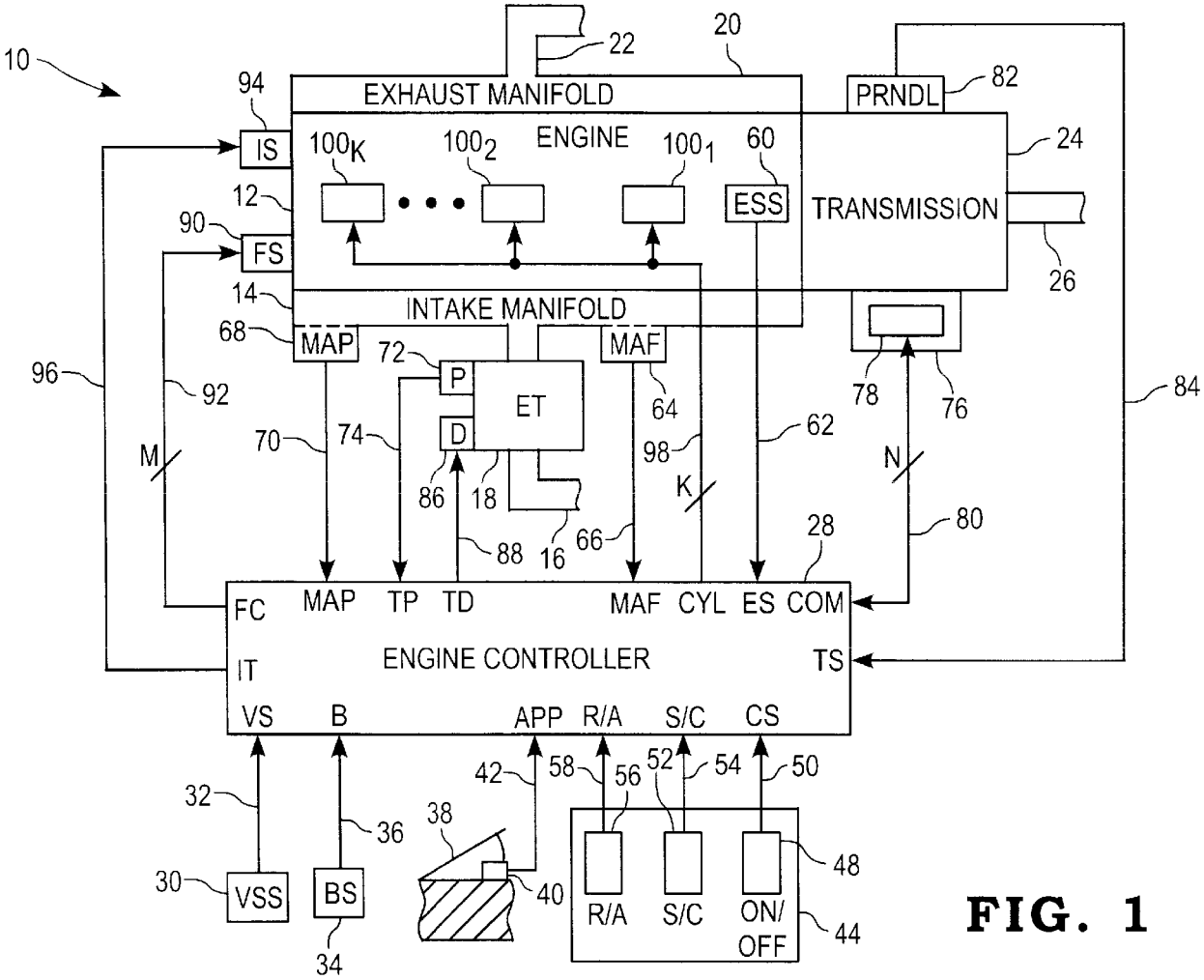
FIG. 1 is a diagrammatic illustration of one preferred embodiment of a system for controllably disabling cylinders in an internal combustion engine, in accordance with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further application of the principles of the invention as illustrated therein being contemplated as would normally occur to one skilled in the art to which the invention relates.

Referring now to FIG. 1, one preferred embodiment of a system 10 for controllably disabling cylinders in an internal combustion engine, in accordance with the present invention, is shown. System 10 includes an engine 12 having an intake manifold 14 fluidly coupled to an intake conduit 16. An electronic throttle 18 is disposed in-line with intake conduitl6, wherein electronic throttle 18 may be of known construction and is operable to control the flow of air entering intake manifold 14 as is known in the art. An exhaust manifold 20 of engine 12 is fluidly coupled to an exhaust gas conduit 22 for expelling to ambient exhaust gas produced by engine 12. A transmission 24 is mechanically coupled to engine 12, and a tailshaft or a propeller shaft 26 extends rearwardly from transmission 24. Output torque produced by engine 12 is multiplied by a gear reduction ratio of transmission 24, and is then transferred by transmission 24 to the wheels (not shown) of the vehicle carrying engine 12 via tailshaft 26, in a manner well-known in the art.

System 10 includes an electronic engine controller 28 that is typically referred to as an electronic control module (ECM) or power train control module (PCM) or power train control module (PCM). Engine controller 28 is a conventional microprocessor-based electronic control circuit that is generally operable to control and manage the overall operation of engine 12.

System 10 includes a number of sensors and/or sensing systems operable to provide engine controller 28 with information relating to the operation of engine 12 and of the vehicle-carrying engine 12. For example, system 10 includes a vehicle speed sensor 30 electrically connected to a vehicle speed input, VS, of engine controller 28 via signal path 32. Vehicle speed sensor 30 is of known construction, and is in one embodiment a variable reluctance sensor disposed about tail shaft 26. Alternatively, the vehicle speed sensor 30 may be a wheel speed sensor or the like, although the present invention contemplates utilizing any known sensor or sensing system operable to supply a vehicle speed signal to engine controller 28 indicative of road speed of the vehicle carrying engine 12.

A service brake sensor 34 is electrically connected to brake input, B, of engine controller 28 via signal path 36. Service brake sensor 34 is of known construction, and in one embodiment is a switch responsive to at least partial depression of the service brakes of the vehicle to provide a signal on signal path 36 indicative of service brake activation. It is to be understood, however, that service brake sensor 34 may take other known forms, and is in any case operable to provide engine controller 28 with information relating to the status of the service brake (i.e. whether or not the service brake pedal is at least partially depressed).

System 10 further includes an accelerator pedal 38 having an accelerator pedal sensor 40 electrically connected to an accelerator pedal position input, APP, of engine controller 28 via signal path 42. Sensor 40 is of known construction, and in one embodiment is a potentiometer having an output signal that varies proportionally to the amount of deflection of accelerator pedal 38. While other known embodiments of sensor 40 are contemplated, any such sensor is for purposes of the present invention operable to provide information to engine controller 28 relating to the amount or percentage of deflection of accelerator pedal 38.

System 10 further includes a cruise control unit 44 of known construction and having an on/off switch 48 electrically connected to cruise switch input, CS, of engine controller 28 via signal path 50. A set/coast switch 52 is electrically connected to a set/coast input, S/C, of engine controller 28 via signal path 54, and a resume/acceleration switch 56 is electrically connected to a resume/acceleration input, R/A, of engine controller 28 via signal path 58. Cruise control unit 44 is a conventional cruise control unit responsive to actuation of any of switches 48, 52 and 56 to provide engine controller 28 with information relating to the on/off status of cruise control unit 44, as well as information relating to the functional operation of cruise control unit 44 such as set speed, coast, resume and acceleration. Engine controller 28 is, in turn, responsive to signals provided at its CS, S/C, and R/A inputs to control the road speed of the vehicle carrying engine 12 in a manner well-known in the art.

System 10 further includes an engine speed sensor 60 electrically connected to an engine speed input, ES, of engine controller 28 via signal path 62. Engine speed sensor 60 is of known construction and is operable to provide engine controller 28 with an engine speed signal indicative of rotational speed of engine 12. In one embodiment, engine speed sensor 60 is a Hall effect sensor operable to sense passage thereby of a number of teeth formed on a gear or tone wheel rotating synchronously with the engine crank shaft (not shown). Alternatively, engine speed sensor 60 may be a variable reluctance sensor or other known sensor operable to provide engine controller 28 with information relating to the rotational speed of eninge 12.

System 10 further includes a mass air flow sensor 64 electrically connected to a mass air flow input, MAF, of engine controller 28 via signal path 66. Mass air flow sensor 64 may be of known construction and is operable to provide a mass air flow signal on signal path 66 indicative of the mass flow of air entering intake manifold 14. A manifold absolute pressure sensor 68 is also disposed in fluid communication with intake manifold 14 and is electrically connected to a manifold absolute pressure input, MAP, of engine controller 28 via signal path 70. Manifold absolute pressure sensor 68 may be of known construction and is operable to provide a pressure signal on signal path 70 indicative of absolute pressure within air intake manifold 14.

Electronic throttle 18 includes a throttle position sensor 72 that is electrically connected to a throttle position input, TP, of engine controller 28 via signal path 74. Throttle position sensor 72 may be of known construction and is operable to provide engine controller 28 with a signal indicative of throttle position, wherein engine controller 28 is operable to process the throttle position signal and determine therefrom the current cross sectional flow area defined through throttle 18.

In one embodiment in system 10, transmission 24 is an automatic or semiautomatic transmission having a number of automatically selectable gear ratios. In this embodiment, transmission 24 includes a transmission control module 76 including a transmission controller 78. Transmission controller 78 is preferably microprocessor-based, and is electrically connected to a communication port, COM, of engine controller 28 via a number, N, of signal paths 80, wherein N may be any positive integer. Signal paths 80, in one embodiment, define a multi-wire communications link configured to conduct communications between engine controller 28 and transmission controller 78 via one or more known communications protocols. Examples of such communications protocols include, but are not limited to, CAN, SAE J-1939, or the like, although the present invention contemplates that signal paths 80 may alternatively define another serial or parallel data comminations link configured to conduct communications between engine controller 28 and transmission controller 78 via other known communications protocols. Also in this embodiment, system 10 includes a manually actuatable transmission status mechanism 82 electrically connected to a transmission status input, TS, of engine controller 28 via signal 84. Mechanism 82 is generally actuatable under control of a vehicle operator to cause the. transmission 24 to operate in a stationary or "parked" (P) condition, reverse gear condition (R), neutral condition (N), "drive" position (D), and a low gear condition (L), as is known in the art. Signal path 84 accordingly carries a transmission status signal indicative of the current operating state of transmission 24. Alternatively, such information may be provided to engine controller 28 by the transmission controller 78 via signal paths 80. In an alternative embodiment of system 10, transmission 24 may be a manual transmission having only manually selectable gear ratios. In this embodiment, transmission control module 76, transmission controller 78 and transmission status mechanism 82 are all omitted, and system 10 in this case includes a manual gear selection lever (not shown) and manually actuated clutch (not shown). In another alternative embodiment of system 10, transmission 24 may be a continuous-variable transmission (CVT) of known construction that is operable to continuously vary the torque reduction ratio between engine 12 and tail shaft 26 as is known in the art. In this embodiment, transmission 24 may or may not include transmission module 76 and transmission controller 78, but will typically include transmission status mechanism 82.

Engine controller 28 also includes a number of outputs for controlling a number of actuators and/or subsystems associated with the operation of engine 12. For example, electronic throttle 18 includes a throttle position driver or actuator 86 electrically connected to a throttle driver output, TD, of engine controller 28 via signal path 88. The electronic throttle driver 86 is responsive to a throttle control signal provided by engine controller 28 on signal path 88 to drive a valve or other adjustable air flow control mechanism of throttle 18 to a corresponding throttle position and thereby define a desired air flow cross sectional flow area of throttle 18. System 10 further includes a fuel system 90 electrically connected to a fueling command output, FC, of engine controller 28 via a number, M, of signal paths 92, wherein M may be any positive integer. Fuel system 90 is of the conventional type and may include a number of individually controllable fuel injectors fluidly coupled to a fuel source (not shown), although the present invention contemplates that fuel system 90 may take other known forms. System 10 also includes an ignition system 94 electrically connected to an ignition timing output, IT, of engine controller 28 via signal path 96. Ignition system 94 is also of the conventional type and is generally operable to control the timing of ignition of the air-fuel mixture within the various cylinders of engine 12, as is known in the art. Engine controller 28 further includes a cylinder control output (CYL) electrically connected to a number, K, of cylinder deactivation devices $\mathbf{100}_1$–$\mathbf{100}_K$, via a corresponding number, K, of signal paths 98, wherein K may be any positive integer. In one embodiment, K is equal to the total number of cylinders of engine 12, and in this embodiment each cylinder of engine 12 has a cylinder deactivation or disabling device 100 associated therewith. It is to be understood, however, that the present invention contemplates other embodiments wherein the number of cylinder deactivation devices is greater or less than the total number of cylinders of engine 12. In any case, each of the cylinder deactivation devices $\mathbf{100}_1$–$\mathbf{100}_K$ may be of known construction, and in one embodiment are configured to disable cylinder operation by disabling the operation of the intake and exhaust valves associated with each cylinder in a manner known in the art.

Figure 2:
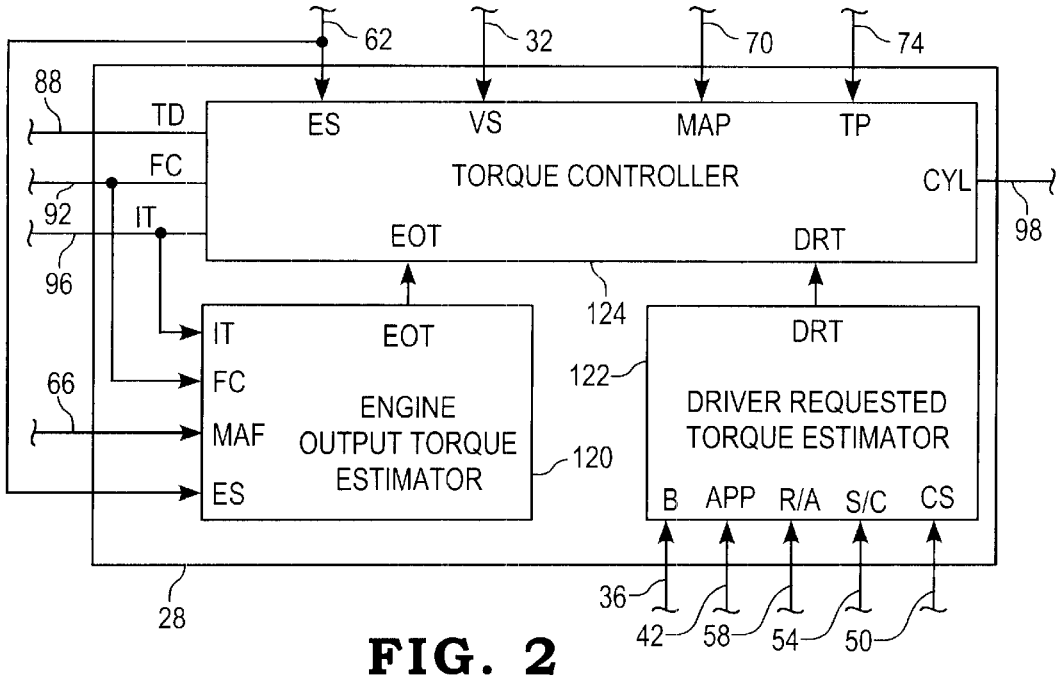
FIG. 2 is a diagrammatic illustration of one preferred embodiment of some of the internal features of the engine controller of FIG. 1, in accordance with the present invention.

Referring now to FIG. 2, one preferred embodiment of at least a portion of engine controller 28, as it relates to the present invention, is shown. Engine controller 28 includes an engine output torque estimator block 120 receiving as inputs the fueling command on signal path 92, the ignition timing signal on signal path 96, mass airflow signal on signal path 66 and the engine speed signal on signal path 62. The engine output torque estimator block 120 is operable to compute an estimate of output torque produced by engine 12 (EOT) as a function of the fueling command, ignition timing, mass airflow and engine speed signals in a known manner. Engine controller 28 further includes a driver requested torque estimator block 122 receiving as input signals the brake status signal on signal path 36, the accelerator pedal position signal on signal path 42, the cruise status signal on signal path 50, the set/coast signal path 54 and the resume/acceleration signal on signal path 58. Block 122 is operable to compute an estimate of the engine output torque requested by the operator, either by actuation of the accelerator pedal 38 or by activation of the cruise control unit 44. If the vehicle operator is currently controlling fueling via accelerator pedal 38, block 122 is operable to estimate the driver requested torque (DRT) as a known function of the accelerator pedal position signal on signal path 42. If, on the other hand, fueling is being controlled by cruise control unit 44, as indicated generally by the statuses of the cruise status signal on signal path 50 and the set/coast signal on signal path 54, block 122 is operable to estimate the driver requested torque (DRT) as a known function of the set speed, coast speed, resume speed and/or acceleration speed. Block 122 is responsive to the brake status signal on signal path 36 while in cruise control mode to estimate DRT as a function of the accelerator pedal signal on signal path 42 when the brake status signal indicates that the service brakes have been activated, thereby disabling cruise control unit 44.

A torque controller block 124 of engine controller 28 receives as inputs the engine speed signal on signal path 62, the vehicle speed signal on signal path 32, the manifold absolute pressure signal on signal path 70, the throttle position signal on signal path 74, the engine output torque estimate (EOT) produced by block 120 and the driver requested torque (DRT) produced by block 122. Torque controller block 124 includes a control algorithm responsive to the foregoing inputs to controllably disable cylinders of engine 12 under certain conditions for the purpose of improving fuel economy in a manner that will be more fully described hereinafter with respect to FIGS. 3–6. In so doing, engine controller 28 may be operable to control any one or more of the cylinder deactivation or disabling devices $\mathbf{100}_1$–$\mathbf{100}_K$, the throttle position of electronic throttle 18, the ignition timing of the ignition system 94, and the fuel supplied to the various cylinders of engine 12 by fuel system 90. In this regard, torque controller block 124 is electrically connected to signal paths 88, 92, 96 and 98, to thereby control any one or more of these actuators and/or systems.

Figure 3A:
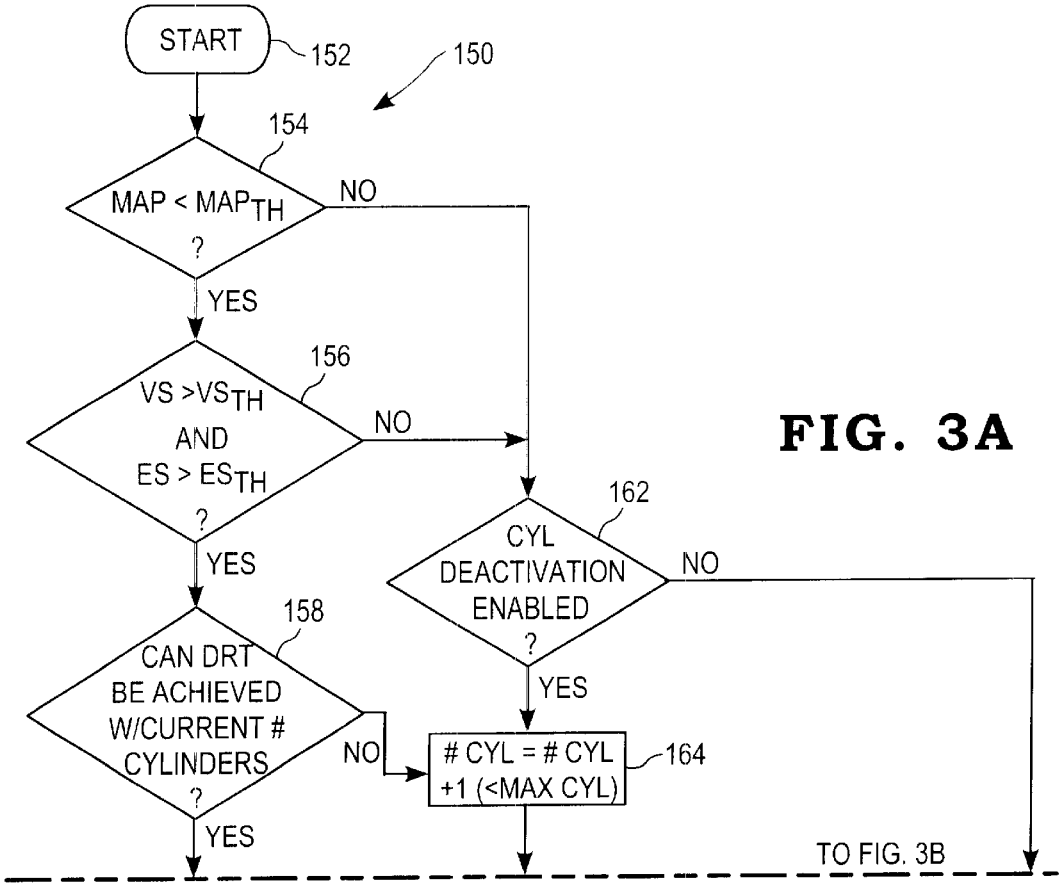
FIGS. 3A and 3B depict a flowchart illustrating one preferred embodiment of a software algorithm for controllably disabling cylinders in an internal combustion engine, in accordance with one aspect of the present invention.
Figure 3B:
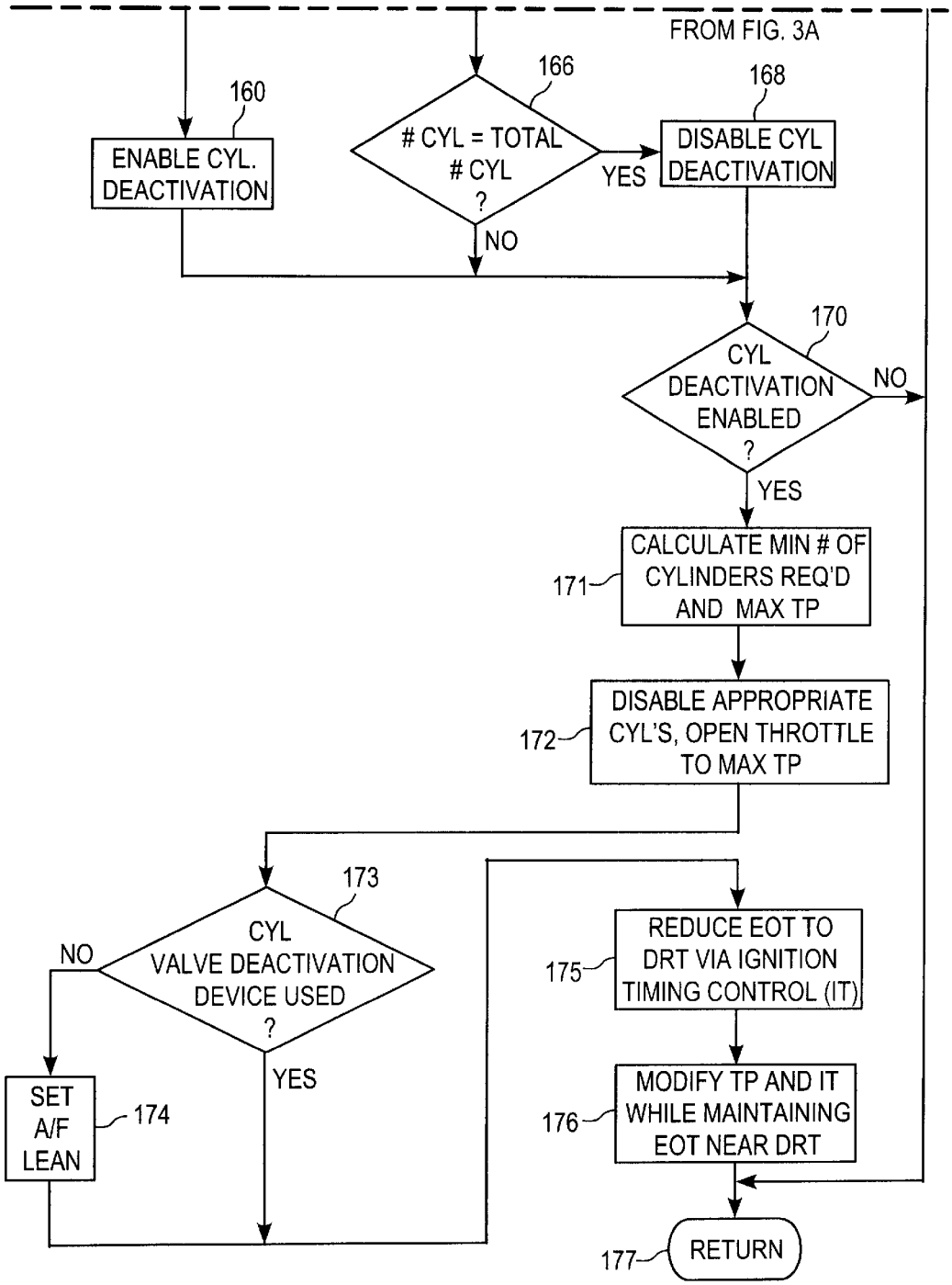

Referring now to FIGS. 3A and 3B, a flowchart is shown illustrating one preferred embodiment of a software algorithm 150 for controllably disabling cylinders of engine 12, in accordance with one aspect of the present invention. In one embodiment, algorithm 150 is executed by engine controller 28, although the present invention contemplates that algorithm may alternatively be executed by transmission controller 78. In either case, any information required by controller 28 or controller 78 may be obtained via signal paths 80. For purposes of the following description, however, algorithm 150 will be described as being executed by engine controller 28.

Algorithm 150 begins at step 152, and at step 154 controller 28 is operable to compare the manifold absolute pressure (MAP) signal on signal path 70 with a threshold manifold absolute pressure value $MAP_{TH}$, wherein $MAP_{TH}$, in one embodiment, corresponds to a manifold absolute pressure below which acceptable brake boost vacuum exists. If, at step 154, MAP is less than $MAP_{TH}$, algorithm execution advances to step 156. If, however, controller 28 determines that MAP is greater than or equal to $MAP_{TH}$, algorithm execution advances to step 162. At step 156, controller 28 is operable to compare the vehicle speed signal, VS, and the engine speed signal, ES, to corresponding vehicle speed and engine speed thresholds, $VS_{TH}$ and $ES_{TH}$, respectively. In one embodiment, $VS_{TH}$ and $ES_{TH}$ represent minimum acceptable driveability thresholds. If, at step 156, controller 28 determines that VS is greater than $VS_{TH}$ and ES is greater than $ES_{TH}$, algorithm execution advances to step 158. If not, algorithm execution advances to step 162. At step 162, controller 28 is operable to determine whether cylinder deactivation, or cylinder disabling operation, has been enabled. If so, algorithm execution advances to step 164. If, on the other hand, controller 28 determines at step 162 that cylinder deactivation has not been enabled, or has been disabled, algorithm execution advances to step 177.

At step 158, controller 28 is operable to determine whether the driver requested torque (DRT) produced by block 122 can be achieved with the number of cylinders of engine 12 that are currently in operation; i.e., with the currently active cylinders. If so, algorithm execution advances to step 160 where controller 28 is operable to enable cylinder deactivation to occur. Algorithm execution advances from step 160 to step 170.

If, at step 158, controller 28 determines that the driver requested torque (DRT) cannot be achieved with the number of cylinders of engine 12 currently in operation; i.e., with the currently active cylinders, algorithm execution advances to step 164 where controller 28 is operable to increase by one the number of cylinders of engine 12 currently in operation as long as the number of cylinders currently in operation is less than the total number (MAXCYL) of cylinders of engine 12. Thereafter at step 166, controller 28 is operable to determine whether the number of cylinders currently in operation is equal to the total number of cylinders of engine 12, and if so algorithm execution advances to step 168 where controller 28 is operable to disable cylinder deactivation. Algorithm execution advances from steps 160 and 168, and from the "no" branch of step 166, to step 170 where controller 28 determines whether cylinder deactivation is enabled. If not, algorithm execution advances to step 177. If, on the other hand, controller 28 determines at step 170 that cylinder deactivation has been enabled, algorithm execution advances to step 171.

At step 171, controller 28 is operable to calculate the minimum number of cylinders of engine 12 to be activated in order to achieve the driver requested torque, DRT, and to calculate a maximum throttle position of throttle 18. Controller 28 is operable at step 171 to calculate the minimum acceptable number of cylinders and the maximum throttle position as a function of the driver requested torque, DRT, supplied by block 122 as well as current engine operating conditions such as engine speed, ES, and manifold absolute pressure, MAP, in a manner known in the art. In one embodiment, for example, the torque controller block 124 includes a look-up table populated with minimum number of acceptable cylinder values and maximum throttle position values as functions of DRT, ES and MAP, although the present invention contemplates that block 124 may include separate look up tables for the minimum number of acceptable cylinder values and the maximum throttle position values. Alternatively still, block 124 may be operable to calculate the minimum acceptable number of cylinders and the maximum throttle position based on one or more charts, graphs and/or known equations. In any case, some of the considerations in determining the minimum acceptable number of cylinders and the maximum throttle position include, but are not limited to, resulting engine roughness (e.g., vibration, etc.) and ability to meet DRT.

Thereafter at step 172, controller 28 is operable to disable appropriate ones of the cylinders of engine 12. In one embodiment, controller 28 is operable at step 172 to disable appropriate ones of the cylinders by controlling corresponding ones of the cylinder disabling devices $\mathbf{100}_1$–$\mathbf{100}_K$. Alternatively, controller 28 may be operable at step 172 to disable appropriate ones of the cylinders by selectively disabling fuel delivery thereto and enabling fuel delivery to the remaining minimum number of cylinders (calculated at step 171) of engine 12. Those skilled in the art will recognize other techniques for selectively disabling the operation of one or more of the cylinders of engine 12, and any such other techniques are intended to fall within the scope of the present invention. Controller 28 is further operable at step 172 to provide a throttle control signal on signal path 88 to which the throttle actuator 86 is responsive to open a valve or other air flow control mechanism of throttle 18 to the maximum throttle position, MAX TP.

In one embodiment of algorithm 150, the torque controller block 124 is configured to compute MAX TP at step 171 such that the resulting engine output torque (EOT) after execution of step 172 is greater than the driver requested torque, DRT. In this embodiment, step 172 advances to step 173 where controller 28 is operable to determine whether cylinder deactivation is being accomplished via a cylinder valve deactivation device. If so, algorithm execution advances to step 175. If, however, controller 28 determines at step 173 that cylinder deactivation is not being accomplished via a cylinder valve deactivation device, then cylinder deactivation is being accomplished, in one embodiment, via selective control of the various fuel injectors of fuel system 90. In this case, algorithm execution advances to step 174 where controller 28 is operable to control the fueling command signals provided on signal paths 92 to establish a lean air-to-fuel ratio.

From the "yes" branch of step 173 and from step 174, algorithm execution advances to step 175 where controller 28 is operable to reduce the engine output torque (EOT) to the driver requested torque (DRT) by monitoring EOT and retarding the ignition timing signal (IT) provided on signal path 96 until EOT reaches DRT. This technique allows rapid engine output torque reduction while preventing torque overshoot. Algorithm execution then advances from step 175 to step 176 where controller 28 is operable to control the throttle position (via control of the throttle control signal on signal path 88) to decrease airflow therethrough while simultaneously advancing the ignition timing signal (IT) on signal path 96 in such a manner that maintains the engine output torque (EOT) near the driver requested torque (DRT). Algorithm execution advances from step 176, and from the "no" branch of steps 162 and 170, to step 177 where algorithm 150 is returned to its calling routine.

In an alternate embodiment of algorithm 150, the torque controller block 124 may be configured to compute MAX TP at step 171 such that the resulting engine output torque (EOT) after execution of step 172 (and possibly step 174) is less than DRT. In this embodiment, controller 28 is then operable at step 175 to increase EOT to DRT by controlling the ignition timing signal (IT) on signal path 88 so as to advance ignition timing. Thereafter at step 176, controller 28 is configured to then control the throttle position (via control of the throttle control signal on signal path 88) to increase airflow therethrough while simultaneously retarding the ignition timing signal (IT) on signal path 96 in such a manner that maintains the engine output torque (EOT) near the driver requested torque (DRT).

Under high air flow conditions through throttle 18, such as during steady state, partial throttle cruise control, engine idling conditions, etc., the engine controller 28 is operable under the direction of algorithm 150 to deactivate various engine cylinders so that the engine 12 must then run at higher manifold absolute pressure conditions and, accordingly, at a higher volumetric efficiency, thereby increasing fuel economy. Controller 28 is operable to sense conditions under which cylinder deactivation is desirable by testing the manifold absolute pressure (MAP) signal, the engine speed signal (ES) and the vehicle speed signals against corresponding threshold values therefore, and then determining whether the desired engine output torque (DRT) can be achieved with less than the total number of cylinders being fueled. If such conditions are appropriate for disabling one or more of the cylinders, controller 28 is then operable to do so while controlling throttle position, ignition timing and air-to-fuel ratio in a manner that compensates for poor driving metrics (e.g., "deep" accelerator pedal, poor accelerator pedal response, etc.). In one embodiment, controller 28 is operable to deactivate one or more of the cylinders by controlling one or more corresponding cylinder deactivation devices $\mathbf{100}_1$–$\mathbf{100}_K$. In an alternative embodiment, controller 28 is operable to deactivate one or more of the cylinders by selectively fueling one or more cylinders of engine 12 via appropriate control of fueling system 90. In this embodiment, controller 28 is further operable to control the fueling commands to provide for a lean air-to-fuel ratio when the one or more cylinders are disabled. In either case, the resulting position of accelerator pedal 38 that is required to maintain a specific road load torque remains constant regardless of the number of cylinders being fueled.

Figure 4:
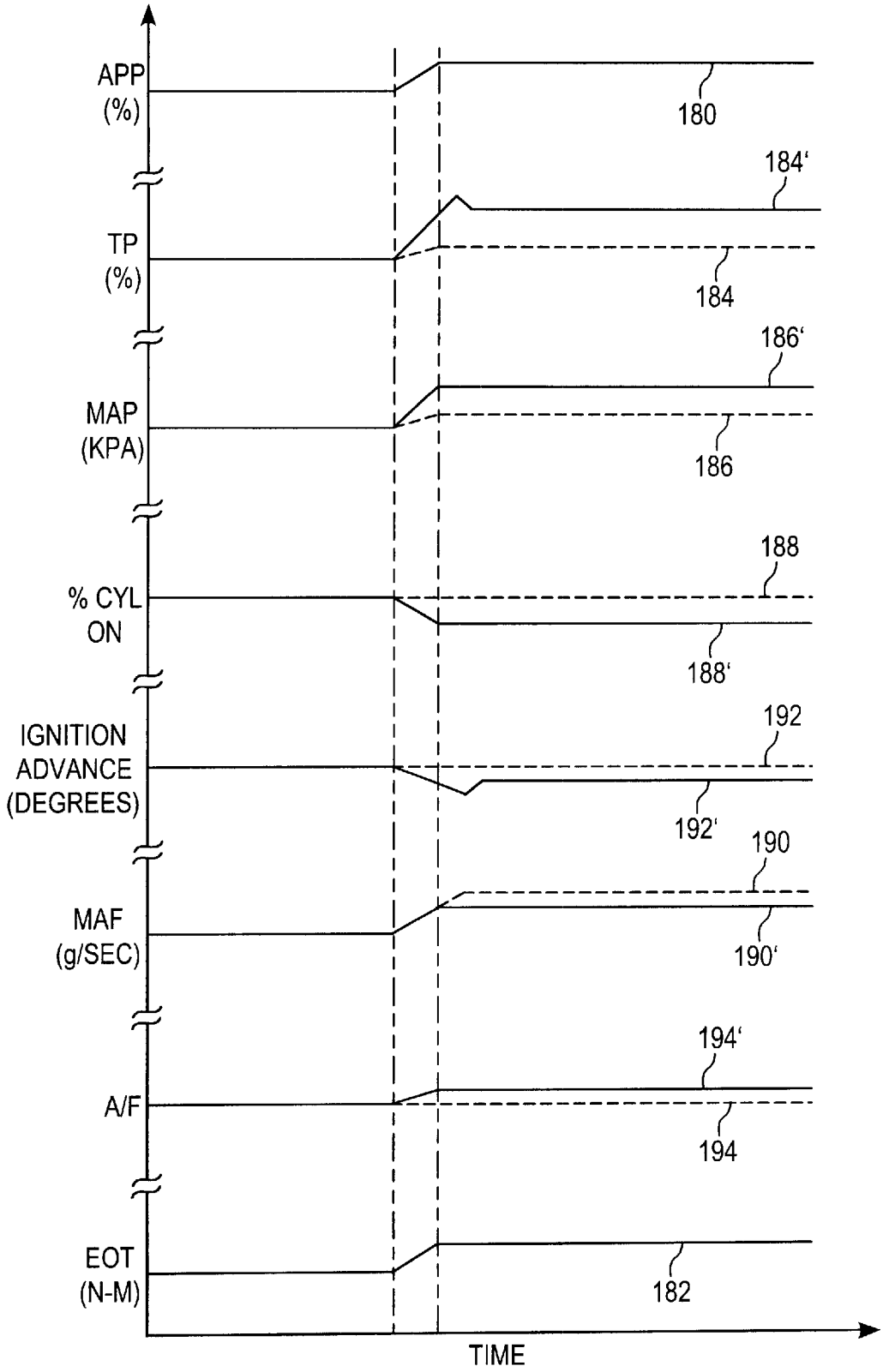
FIG. 4 is a plot of a number of engine operating conditions vs. time illustrating and comparing engine operation with and without the algorithm of FIG. 3.

Referring to FIG. 4, some of the operating parameters of engine 12 are shown illustrating parameter behavior when controller 28 executes algorithm 150 as compared with parameter behavior when controller 28 does not execute algorithm 150, under conditions indicative of an increase in engine output power, followed by steady state operation. For example, when the accelerator pedal position signal 180 (typically in units of % pedal deflection) is increased, engine output torque 182 (typically in units of N-M) increases as a result. Without algorithm 150, the throttle position signal 184 would rise slowly in response as would the manifold absolute pressure signal 186 (typically in units of % of maximum throttle opening) and the mass air flow signal 190 (typically in units of KPA). The number (percentage) of active cylinders 188 would remain constant, as would the ignition timing signal 192 (typically in units of degrees) and the air-to-fuel ratio value 194. With controller 28 executing algorithm 150 such that cylinder deactivation is enabled, by contrast, an increase in the accelerator pedal signal 180 and engine output torque 182 results in a rapid opening of throttle 18 and attendant rapid increase in air volume supplied to the intake manifold 14, as indicated by the throttle position signal 184', as well as a decrease in the number (percentage) of cylinders being fueled 188'. The manifold absolute pressure signal 186' likewise increases rapidly as does the air-to-fuel ratio value 194 (only in embodiments wherein cylinder deactivation is accomplished via selectively enabling fuel delivery to appropriate cylinders), indicating a leaner air-to-fuel mixture, and the mass air flow signal 190' decreases as a result of deactivation of various ones of the engine cylinders. The ignition timing signal 192' is retarded (decreases) initially, and is thereafter advanced (increased) coincident with a decrease in the, throttle position signal 184' from its peak value. Both signals 184' and 192' thereafter reach steady state values.

Figure 5A:
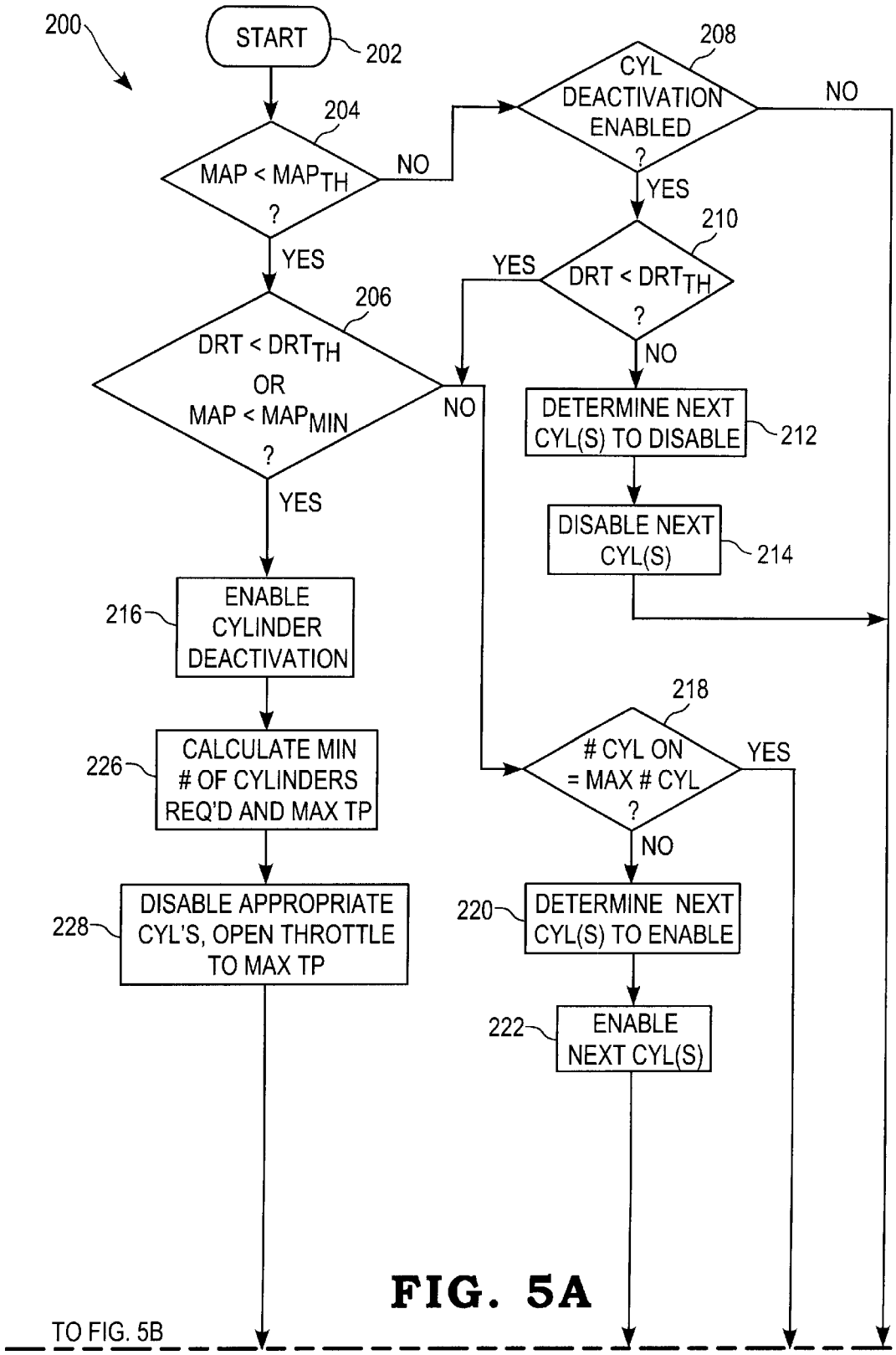
FIGS. 5A and 5B depict a flowchart illustrating one preferred embodiment of another software algorithm for controllably disabling cylinders in an internal combustion engine, in accordance with another aspect of the present invention.
Figure 5B:
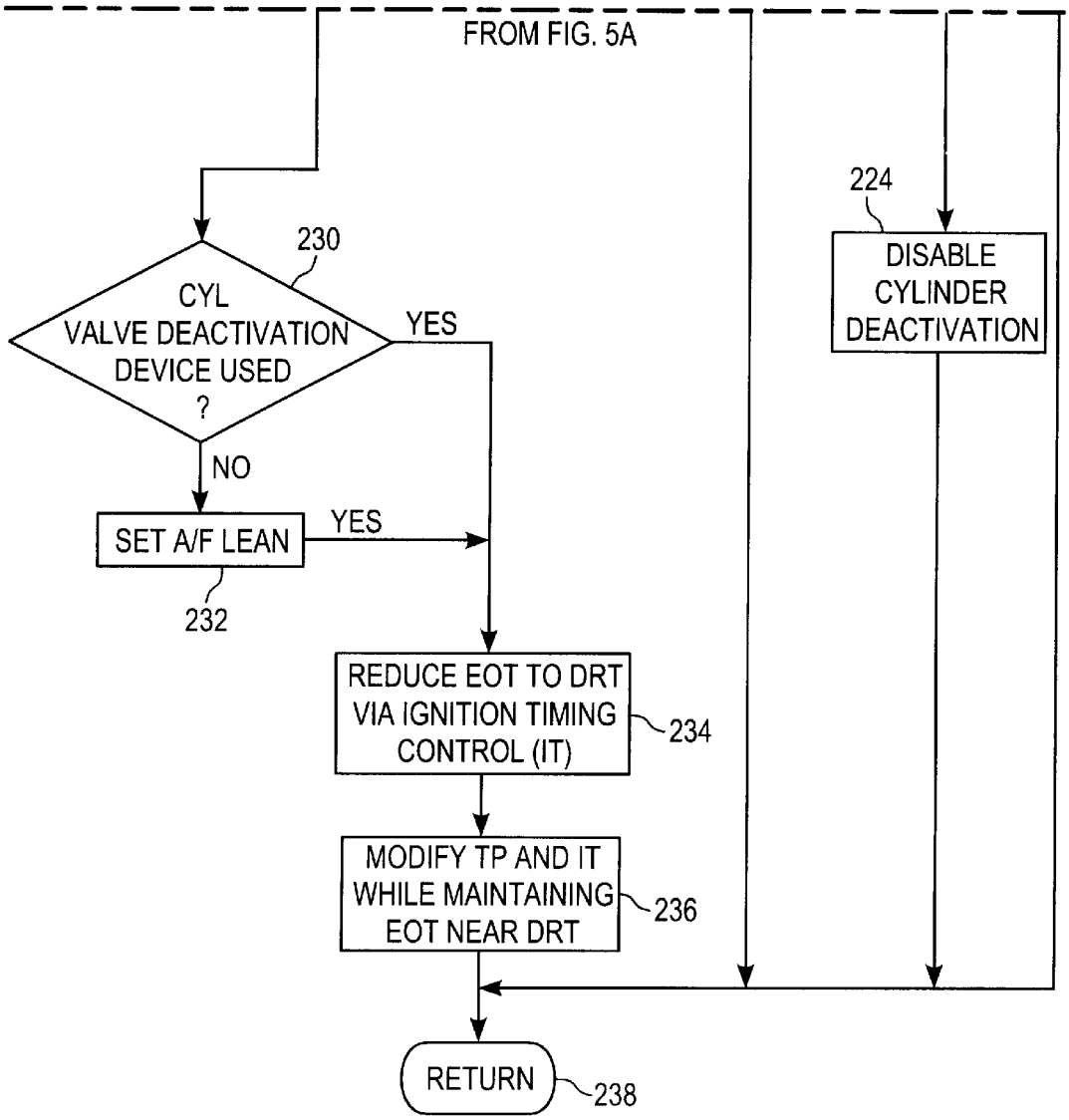

Referring now to FIGS. 5A and 5B, a flowchart is shown illustrating another embodiment of a software algorithm 200 for controllably disabling cylinders of engine 12, in accordance with another aspect of the present invention. In one embodiment, algorithm 200 is executed by engine controller 28, although the present invention contemplates that algorithm may alternatively be executed by transmission controller 78. In either case, any information required by controller 28 or controller 78 may be obtained via signal paths 80. For purposes of the following description, algorithm 200 will be described as being executed by engine controller 28.

Algorithm 200 begins at step 202, and at step 204 controller 28 is operable to compare the manifold absolute pressure (MAP) signal on signal path 70 with a threshold manifold absolute pressure value $MAP_{TH}$, wherein $MAP_{TH}$, in one embodiment, corresponds to a manifold absolute pressure below which acceptable brake boost vacuum exists. If MAP is less than $MAP_{TH}$, algorithm execution advances to step 206. If, however, controller 28 determines at step 204 that MAP is greater than or equal to $MAP_{TH}$, algorithm execution advances to step 208.

At step 206, controller 28 is operable to either compare the driver requested torque, DRT, to a driver requested torque threshold, $DRT_{TH}$, or to compare the manifold absolute pressure (MAP) signal on signal path 70 with a minimum manifold absolute pressure value $MAP_{MIN}$. In one embodiment, the minimum torque threshold, $DRT_{TH}$, is set at a level below which acceptable combustion occurs with all cylinders of engine 12 active, and the minimum manifold absolute pressure threshold, $MAP_{MIN}$, corresponds to a similar threshold in terms of manifold absolute pressure. In either case, if DRT is less than $DRT_{TH}$, or MAP is less than $MAP_{MIN}$ at step 206, algorithm execution advances to step 216 where controller 28 is operable to enable the cylinder deactivation feature. If not, algorithm execution advances to step 218.

At step 208, controller 28 is operable to determine whether the cylinder deactivation feature has been enabled, and if so algorithm execution advances to step 210. If not, algorithm execution advances to step 238. At step 210, controller 28 is operable to compare the driver requested torque, DRT, to the driver requested torque threshold, $DRT_{TH}$, and if DRT is less than $DRT_{TH}$ algorithm execution advances to step 218. If, on the other hand, controller 28 determines at step 210 that DRT is greater than or equal to $DRT_{TH}$, algorithm execution advances to step 212 where controller 28 is operable to determine the next one or more of the currently active cylinders to disable or deactivate. Thereafter at step 214, controller 28 is operable to disable or deactivate the one or more cylinders identified at step 212. Algorithm execution advances from step 214 to step 238.

At step 218, controller 28 is operable to determine whether the number of currently active or operating cylinders of engine 12 is equal to the total number (MAX #CYL) of cylinders of engine 12. If so, algorithm execution advances to step 224 where controller 28 is operable to disable the cylinder deactivation feature. If, on the other hand, controller 28 determines at step 218 that the number of currently operating cylinders is not equal to MAX #CYL, algorithm execution advances to step 220 where controller 28 is operable to determine the next one or more of the currently inactive cylinders to activate or enable. Thereafter at step 222, controller 28 is operable to enable the one or more cylinders identified at step 220. Algorithm execution advances from step 222 to step 238.

Following step 216, algorithm execution advances to step 226 where controller 28 is operable to calculate the minimum number of cylinders of engine 12 to be activated in order to achieve the driver requested torque, DRT, and to calculate a maximum throttle position of throttle 18. Controller 28 is operable at step 226 to calculate the minimum acceptable number of cylinders and the maximum throttle position as a function of the driver requested torque, DRT, supplied by block 122 as well as current engine operating conditions such as engine speed, ES, and manifold absolute pressure, MAP, in a manner known in the art. In one embodiment, for example, the torque controller block 124 includes a look-up table populated with minimum number of acceptable cylinder values and maximum throttle position values as functions of DRT, ES and MAP, although the present invention contemplates that block 124 may include separate look up tables for the minimum number of acceptable cylinder values and the maximum throttle position values. Alternatively still, block 124 may be operable to calculate the minimum acceptable number of cylinders and the maximum throttle position based on one or more charts, graphs and/or known equations. In any case, some of the considerations in determining the minimum acceptable number of cylinders and the maximum throttle position include, but are not limited to, resulting engine roughness (e.g., vibration, etc.) and ability to meet DRT.

Thereafter at step 228, controller 28 is operable to disable appropriate ones of the cylinders of engine 12 and to provide a throttle control signal on signal path 88 to which the throttle actuator 86 is responsive to open a valve or other air flow control mechanism of throttle 18 to the maximum throttle position, MAX TP. In one embodiment, controller 28 is operable at step 228 to disable appropriate ones of the cylinders by controlling corresponding ones of the cylinder disabling devices $\mathbf{100}_1$–$\mathbf{100}_K$. Alternatively, controller 28 may be operable at step 228 to disable appropriate ones of the cylinders by selectively disabling fuel delivery thereto and enabling fuel delivery to the remaining minimum number of cylinders (calculated at step 226) of engine 12. Those skilled in the art will recognize other techniques for selectively disabling the operation of one or more of the cylinders of engine 12, and any such other techniques are intended to fall within the scope of the present invention.

In one embodiment of algorithm 200, the torque controller block 124 is configured to compute MAX TP at step 226 such that the resulting engine output torque (EOT) after execution of step 228 is greater than the driver requested torque, DRT. In this embodiment, step 228 advances to step 230 where controller 28 is operable to determine whether cylinder deactivation is being accomplished via a cylinder valve deactivation device. If so, algorithm execution advances to step 234. If, however, controller 28 determines at step 230 that cylinder deactivation is not being accomplished via a cylinder valve deactivation device, then cylinder deactivation is being accomplished, in one embodiment, via selective control of the various fuel injectors of fuel system 90. In this case, algorithm execution advances to step 232 where controller 28 is operable to control the fueling command signals provided on signal paths 92 to establish a lean air-to-fuel ratio. Algorithm execution advances from step 232 and from the "yes" branch of step 230 to step 234.

In one embodiment of algorithm 200, the torque controller block 124 is configured to compute MAX TP at step 226 such that the resulting engine output torque (EOT) after execution of step 228 (and possibly step 232) is greater than the driver requested torque, DRT. In this embodiment, controller 28 is operable at step 234 to reduce the engine output torque (EOT) to the driver requested torque (DRT) by monitoring EOT and retarding the ignition timing signal (IT) provided on signal path 96 until EOT reaches DRT. This technique allows rapid engine output torque reduction while preventing torque overshoot. Algorithm execution then advances from step 234 to step 236 where controller 28 is operable to control the throttle position (via control of the throttle control signal on signal path 88) to decrease airflow therethrough while simultaneously advancing the ignition timing signal (IT) on signal path 96 in such a manner that maintains the engine output torque (EOT) near the driver requested torque (DRT). Algorithm execution advances from steps 214, 222, 224, 236 and the "no" branch of step 208 to step 238 where algorithm 200 is returned to its calling routine.

In an alternate embodiment of algorithm 200, the torque controller block 124 may be configured to compute MAX TP at step 226 such that the resulting engine output torque (EOT) after execution of step 216 is less than DRT. In this embodiment, controller 28 is then operable at step 234 to increase EOT to DRT by controlling the ignition timing signal (IT) on signal path 88 so as to advance ignition timing. Thereafter at step 236, controller 28 is configured to then control the throttle position (via control of the throttle control signal on signal path 88) to increase airflow therethrough while simultaneously retarding the ignition timing signal (IT) on signal path 96 in such a manner that maintains the engine output torque (EOT) near the driver requested torque (DRT).

When entering and exiting deceleration fuel cutoff (DFCO), which condition was defined hereinabove in the BACKGROUND section, the engine controller 28 is operable under the direction of algorithm 200 to deactivate various engine cylinders so that the engine 12 must then run at higher manifold absolute pressure conditions which prevents, or at least inhibits, combustion instability in the fueled cylinders, and thereby improves fuel economy while decreasing hydrocarbon emissions as compared with other known cylinder disabling strategies. Controller 28 is operable to sense conditions under which cylinder deactivation is desirable by testing the manifold absolute pressure (MAP) signal, and either the driver requested torque, DRT, or the manifold absolute pressure signal (MAP) once again, against corresponding threshold values therefor. If such conditions are appropriate for disabling fuel to one or more of the cylinders, controller 28 is then operable to do so while controlling throttle position, ignition timing and, in some embodiments, air-to-fuel ratio, in a manner that provides improved control during transitions to and from zero indicated torque (DFCO). With the control strategy of the present invention, manifold pressures are increased (less vacuum) during these transitions and at DFCO, resulting in reduced hydrocarbon emissions.

Figure 6:
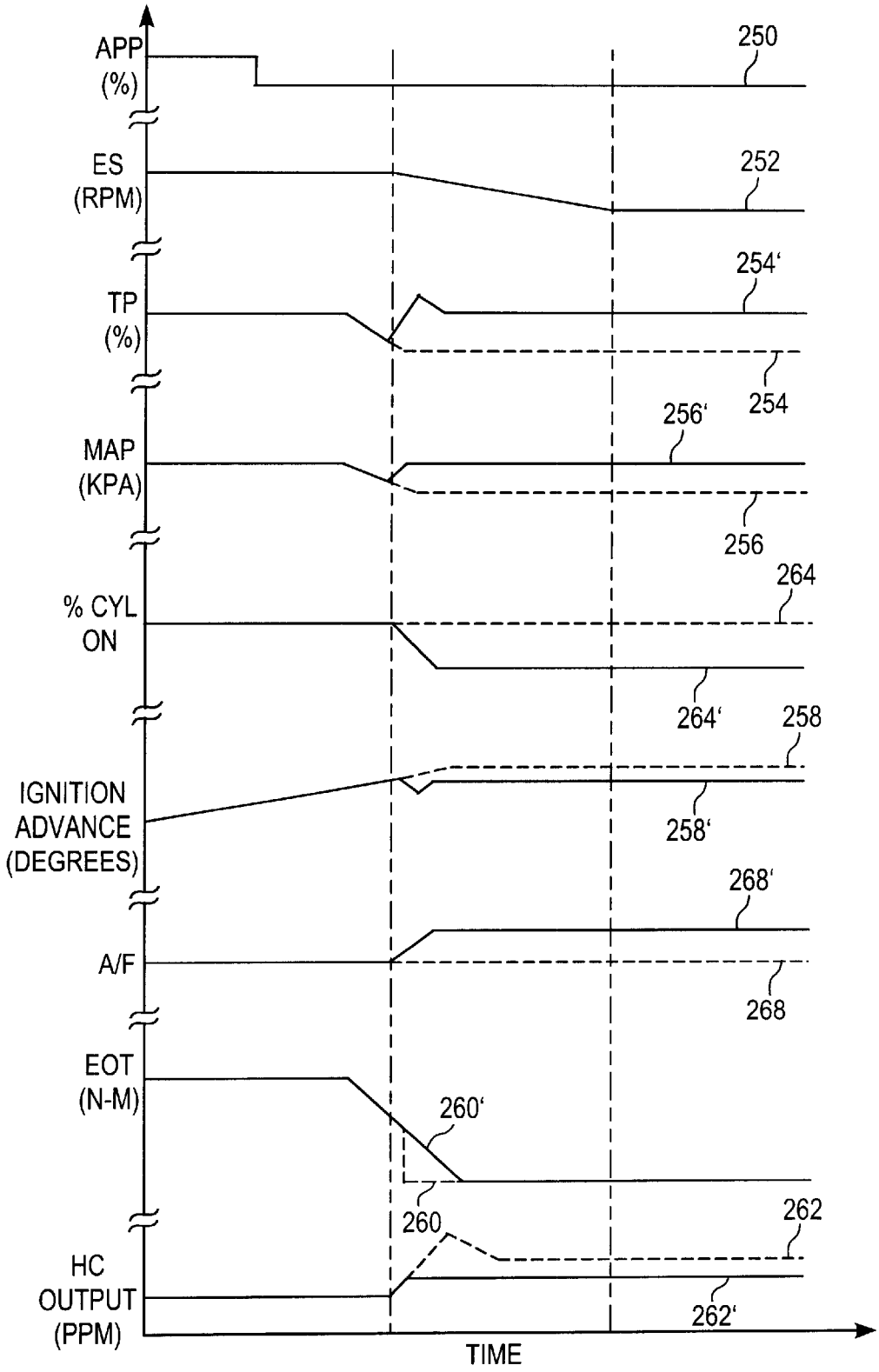
FIG. 6 is a plot of a number of engine operating conditions vs. time illustrating and comparing engine operation with and without the algorithm of FIGS. 5A AND 5B.

Referring to FIG. 6, some of the operating parameters of engine 12 are shown illustrating parameter behavior when controller 28 executes algorithm 200 as compared with parameter behavior when controller 28 does not execute algorithm 200, under conditions indicative of a decrease in engine output power followed by steady state operation. For example, after the accelerator pedal position signal 250 (typically in units of % pedal deflection) is decreased, engine speed 252 (typically in units of RPM) decreases as a result. Without algorithm 200, the throttle position signal 254 (typically in units of % of maximum throttle opening) would decrease slowly to a steady state value in response to the decrease in the accelerator pedal signal 250, as would the manifold absolute pressure signal 256 (typically in units of KPA), while the ignition timing signal 258 (typically in units of degrees) would advance gradually to a steady state value. The number (percentage) of cylinders being fueled 264 would remain constant, as would the air-to-fuel ratio value 268. The engine output torque signal 260 (typically in units of N-M) would decrease slowly at first, and then abruptly to a steady state value as the result of the decreasing manifold absolute pressure 256 and throttle position 254. The sharp decrease in the engine output torque 260, under these operating conditions, would then cause a sharp increase in hydrocarbon emissions 262 (typically in units of PPM).

With controller 28 executing algorithm 200 such that cylinder deactivation is enabled, by contrast, a decrease in the accelerator pedal signal 250 results in a gradually decreasing throttle position 254' and manifold absolute pressure 256' until engine speed 252 begins to decrease. At this point, the number of cylinders 264' enabled for operation decreases, the air-to-fuel ratio 268' increases (only in embodiments wherein cylinder disabling or deactivation is controlled via selective enabling of fuel delivery to appropriate cylinders), the throttle position 254' increases sharply to a peak value and the manifold absolute pressure 256' increases. The engine output torque 260' also decreases slowly and linearly, and the ignition timing 258' is initially retarded, and then again advanced as the throttle position 254' is decreases to a steady state value. Because the engine output torque 260' decreases slowly and linearly, the hydrocarbon output 262 does not peak sharply, but instead rises slowly and linearly to a value that is less than would otherwise occur without algorithm 200. After the ignition timing signal 258' and throttle position signal 254' reach steady state, the engine output torque 260 likewise reaches steady state.

While the invention has been illustrated and described in detail in the foregoing drawings and description, the same is to be considered as illustrative and not restrictive in character, it being understood that only the preferred embodiments have been shown and described and that all changes and modifications that come within the spirit of the invention are desired to be protected.

What is claimed is:

1. A method of controllably disabling cylinders in an internal combustion engine, the method comprising the steps of:

determining air pressure within an intake manifold of the engine;

determining rotational speed of the engine;

determining road speed of a vehicle carrying the engine; and disabling operation of a number of cylinders of the engine while maintaining an engine/vehicle operating parameter near a desired value of the engine/vehicle operating parameter if the air pressure is below a pressure threshold, the rotational speed of the engine is greater than an engine speed threshold and the road speed of the vehicle is greater than a vehicle speed threshold.

2. The method of claim 1 further including the step of determining whether the desired value of the engine/vehicle operating parameter can be achieved by operation of the currently enabled cylinders of the engine;

and wherein the disabling step is further conditioned upon the desired value of the engine/vehicle operating parameter being achievable by operation of the currently enabled cylinders of the engine.

3. The method of claim 2 further including the following steps if the desired value of the engine/vehicle operating parameter cannot be achieved by operation of the currently enabled cylinders of the engine:

determining whether the number of currently operating cylinders equals the total number of cylinders of the engine;

increasing the number of cylinders in operation if the number of currently operating cylinders does not equal the total number of cylinders and executing the disabling step thereafter, and otherwise inhibiting execution of the disabling step.

4. The method of claim 1 wherein the disabling step includes:

computing a minimum number of a total number of cylinders required to achieve the desired value of the engine/vehicle operating parameter;

computing a maximum throttle position of an air intake throttle controlling air flow into an intake manifold of the engine;

enabling operation of the minimum number of cylinders while disabling operation of remaining ones of the total number of cylinders;

opening the air intake throttle to the maximum throttle position;

determining a current value of the engine/vehicle operating parameter;

controlling ignition timing sufficiently to drive the current value of the engine/vehicle operating parameter to the desired engine/vehicle operating parameter value; and modifying the flow area of the air intake throttle while controlling ignition timing sufficiently to maintain the current value of the engine/vehicle operating parameter near the desired engine/vehicle operating parameter value.

5. The method of claim 1 wherein the engine/vehicle operating parameter is one of engine output torque and engine output power.

6. The method of claim 1 wherein the engine/vehicle operating parameter is the rotational speed of the engine.

7. The method of claim 1 wherein the engine/vehicle operating parameter is the road speed of the vehicle.

8. A method of controllably disabling cylinders in an internal combustion engine, the method comprising the steps of:

determining air pressure within an intake manifold of the engine; and disabling operation of a number of cylinders of the engine while maintaining a current value of an engine/vehicle operating parameter near a desired value of the engine/vehicle operating parameter if the air pressure is below a first pressure threshold and one of the desired value of the engine/vehicle operating parameter is below an operating parameter threshold and the air pressure is below a second pressure threshold.

9. The method of claim 8 further including the following steps if one of the desired value of the engine/vehicle operating parameter is below the operating parameter threshold and the air pressure is below the second pressure threshold:

determining whether the number of cylinders currently in operation equals the total number of cylinders of the engine;

increasing the number of cylinders currently in operation if the number of cylinders currently in operation does not equal the total number of cylinders and executing the disabling step thereafter, and otherwise inhibiting execution of the disabling step.

10. The method of claim 8 further including the following steps if the air pressure is not below the first pressure threshold:

determining whether cylinder disabling operation is allowed; and decreasing the number of cylinders currently in operation if cylinder disabling operation is allowed and the desired value of the engine/vehicle operating parameter is not below the operating parameter threshold and executing the disabling step thereafter.

11. The method of claim 10 further including the step of inhibiting execution of the disabling step if cylinder disabling operation is not allowed.

12. The method of claim 10 further including the following steps if cylinder disabling operation is allowed and the desired value of the engine/vehicle operating parameter is below the operating parameter threshold:

determining whether the number of cylinders currently in operation equals the total number of cylinders of the engine;

increasing the number of cylinders currently in operation if the number of cylinders currently in operation does not equal the total number of cylinders and executing the disabling step thereafter, and otherwise inhibiting execution of the disabling step.

13. The method of claim 8 wherein the disabling step includes:

computing a minimum number of a total number of cylinders required to achieve the desired value of the engine/vehicle operating parameter;

computing a maximum throttle position of an air intake throttle controlling air flow into an intake manifold of the engine;

enabling operation of the minimum number of cylinders while disabling operation of remaining ones of the total number of cylinders;

opening the air intake throttle to the maximum throttle position;

determining a current value of the engine/vehicle operating parameter;

controlling ignition timing sufficiently to drive the current value of the engine/vehicle operating parameter to the desired engine/vehicle operating parameter value; and modifying the flow area of the air intake throttle while controlling ignition timing sufficiently to maintain the current value of the engine/vehicle operating parameter near the desired engine/vehicle operating parameter value.

14. The method of claim 8 wherein the engine/vehicle operating parameter is one of engine output torque and engine output power.

15. The method of claim 8 wherein the engine/vehicle operating parameter is the rotational speed of the engine.

16. The method of claim 8 wherein the engine/vehicle operating parameter is the road speed of the vehicle.

* * * * *